US008191734B2

(12) United States Patent
Lupfer

(10) Patent No.: US 8,191,734 B2
(45) Date of Patent: Jun. 5, 2012

(54) METHOD AND APPARATUS FOR GASIFYING AND/OR MAINTAINING GASIFICATION IN LIQUIDS

(76) Inventor: Christopher Lupfer, Huntersville, NC (US)

( * ) Notice: Subject to any disclaimer, the term of this patent is extended or adjusted under 35 U.S.C. 154(b) by 0 days.

(21) Appl. No.: 13/021,291

(22) Filed: Feb. 4, 2011

(65) Prior Publication Data

US 2011/0210144 A1 Sep. 1, 2011

Related U.S. Application Data

(63) Continuation-in-part of application No. 11/622,067, filed on Jan. 11, 2007, now abandoned.

(60) Provisional application No. 60/757,974, filed on Jan. 11, 2006.

(51) Int. Cl.
*B67D 7/00* (2010.01)

(52) U.S. Cl. ..... 222/5; 222/3; 222/396; 222/399; 141/329

(58) Field of Classification Search ..... 222/3, 4, 222/396–397, 399, 400.7, 402.15, 402.13, 222/325, 129.1, 80–82, 5; 141/4, 319, 320, 141/329, 330
See application file for complete search history.

(56) References Cited

U.S. PATENT DOCUMENTS

| | | | | |
|---|---|---|---|---|
| 2,705,578 | A | 4/1955 | Burns | |
| 2,805,846 | A | 9/1957 | Dewan | |
| 3,933,282 | A | 1/1976 | Stevens, Jr. | |
| 3,953,550 | A | 4/1976 | Gilbey | |
| 4,342,710 | A | 8/1982 | Adolfsson et al. | |
| 4,481,986 | A | 11/1984 | Meyers | |
| 4,610,282 | A | 9/1986 | Brooks et al. | |
| 4,636,337 | A | 1/1987 | Gupta et al. | |
| 4,679,602 | A | 7/1987 | Hollis et al. | |
| 4,684,037 | A | 8/1987 | Gnutti et al. | |
| 4,867,209 | A | 9/1989 | Santoiemmo | |
| 4,934,543 | A | 6/1990 | Schmidt | |
| 4,940,212 | A | 7/1990 | Burton | |
| 4,976,894 | A | 12/1990 | Robinson | |
| 5,143,236 | A * | 9/1992 | Gueret | 215/311 |
| 5,294,021 | A | 3/1994 | Ducker et al. | |
| 5,529,220 | A | 6/1996 | Credle, Jr. et al. | |
| 5,566,858 | A | 10/1996 | Ducker, III | |
| 5,651,477 | A | 7/1997 | Takahashi et al. | |
| 6,036,054 | A | 3/2000 | Grill | |
| 6,328,543 | B1 * | 12/2001 | Benecke | 417/411 |
| 6,742,772 | B2 | 6/2004 | Kiefer | |
| 7,100,799 | B2 | 9/2006 | Gruenewald et al. | |
| 2005/0178801 | A1 | 8/2005 | Lambrecht | |

OTHER PUBLICATIONS

Fizz-Giz Retail Kit; accessed Apr. 27, 2010 at http://www.fizzgiz.com/competitors_and_dyi_options.htm.
Sodastream; accessed May 10, 2010 at http://www.sodastreamusa.comlbottles.aspx.

(Continued)

*Primary Examiner* — Frederick C. Nicolas
(74) *Attorney, Agent, or Firm* — Summa, Additon & Ashe, P.A.

(57) ABSTRACT

Embodiments of a method and apparatus for gasifying and maintaining gasification of a liquid contained in a resealable container are provided herein. In some embodiments, a gas delivery system for gasifying a liquid is provided, including a storage vessel for storing a gas; a controllable release mechanism; and an output device for facilitating delivery of a gas from the storage vessel via the controllable release mechanism.

20 Claims, 8 Drawing Sheets

OTHER PUBLICATIONS

Carbonating at Home with Improvised Equipment and Soda Fountains; accessed Apr. 27, 2010 at http://www.truetex.com/carbonation.htm.
The Carbonator Cap; accessed Apr. 27, 2010 at http://www.weekendbrewer.com/carbonatorcap.htm.
Millennium Sparkling Wine Kit Instructions; accessed May 10, 2010 at www.myhomebrew.com.
Carbonation nation: a step-by-step guide to home carbonation; accessed Apr. 27, 2010 at http://foo.net/~jmgray/carbonation/.
3 Liter Pop Bottle Mini-Kegs; accessed May 10, 2010 at http://home.chattanooga.net/~cdp/31keg/31keg.htm.
bbum's weblog-o-mat >> Blog Archive >> Forced Carbonation; accessed May 10, 2010 at http://www.friday.com/bbum/2009/07/18/forced-carbonation/comment-page-1/.
Build Your Own Carbonator Cap; accessed May 10, 2010 at http://www.examiner.com/x-12136-Wichita-Home-Brewing-Examiner~y2009m7d6-Build....
Soda Siphons and co2 cartridges—Carbonate water with ISI soda siphons; accessed May 10, 2010 at http://www.easywhip.com/soda-siphons.html.
Seltzer Sisters; accessed May 10, 2010 at http://seltersisters.com.
"About the Penguin," http://.www.sodaclubusa.com/Penguin/about.htm., printed from Soda-Club web site on Apr. 13, 2007.

* cited by examiner

METHOD AND APPARATUS FOR GASIFYING AND/OR MAINTAINING GASIFICATION IN LIQUIDS

CROSS-REFERENCE TO RELATED APPLICATIONS

This application claims the benefit of provisional Application Ser. No. 60/757,974, entitled "Method and Apparatus For Gasifying and/or Maintaining Gasification in Liquids", filed Jan. 11, 2006, the disclosure of which is incorporated herein by reference in its entirety. This application furthermore claims the benefit of non-provisional Application Ser. No. 11/622,067, entitled "Method and Apparatus For Gasifying and/or Maintaining Gasification in Liquids," filed Jan. 11, 2007, the disclosure of which is incorporated herein by reference in its entirety.

BACKGROUND OF THE INVENTION

1. Field of the Invention

The present invention generally relates to a method and apparatus for gasifying and maintaining gasification in liquids. More specifically, the present invention relates to a method and apparatus for carbonating and re-carbonating beverages sold in conventional disposable and/or recyclable containers.

2. Description of the Related Art

It is known in the art that carbon dioxide gas may be injected into certain liquids to create carbonated beverages. Some liquids such as soda, water, and beer are sold to the general public in a pre-carbonated form. However, soon after the consumer opens the beverage container, the carbon dioxide gas slowly escapes from the beverage, causing it to decarbonate. This occurs even when the container is re-sealed between uses. Many devices which enable an ordinary consumer to carbonate or re-carbonate beverages currently exist on the market. Nevertheless, such devices carry several drawbacks such as a lack of portability and/or versatility and high maintenance costs.

Two examples of "portable" or "home-use" carbonation devices is described in U.S. Pat. No. 4,481,986, issued Nov. 13, 1984 to Meyers and U.S. Pat. No. 4,976,894, issued Dec. 11, 1990 to Robinson. The devices described in each of these patents are portable tabletop carbonated beverage making apparatus. However, these devices are bulky and are required to stand on a table during operation due to the design and operation of the device. Also, these devices require the user expend the high costs to purchase and maintain the device in accordance with their intended use.

Therefore, a need exists for a device which can carbonate and maintain carbonation in bottled beverages while remaining versatile and economical.

SUMMARY OF THE INVENTION

Embodiments of the present invention provide a method and apparatus for gasifying and maintaining gasification of a liquid contained in a resealable container, such as a bottled beverage. In one embodiment, a gas delivery system for gasifying a liquid comprises a storage vessel for storing a gas, a handheld controllable release mechanism, and an output device for facilitating delivery of a gas from the storage vessel via the controllable release mechanism.

In another embodiment, a liquid gasification system comprises a container at least partially filled with a liquid, a cap sealing an open section of the container, and a gas delivery system comprising a storage vessel for storing a gas, a controllable release mechanism, and an output device for facilitating delivery of a gas from the storage vessel via the controllable release mechanism, to an interior of the container.

In yet another embodiment, a kit for gasifying a liquid contained in a resealable container, comprises a cap for a container having an opening disposed in a top surface thereof, a seal configured to fit with the cap and rest against an inner top surface thereof, and a gas delivery system comprising a controllable release mechanism, and an output device for facilitating delivery of a gas via the controllable release mechanism.

BRIEF DESCRIPTION OF THE DRAWINGS

So the manner in which the above recited features of the present invention can be understood in detail, a more particular description of the invention, briefly summarized above, may be had by reference to the embodiments thereof, some of which are illustrated in the appended drawings. It is to be noted, however, the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures

DETAILED DESCRIPTION

The present invention generally provides for a method and apparatus for gasifying and/or maintaining the gasification of liquids stored in resealable containers. In one exemplary application, described in the embodiments depicted below, a method and apparatus is provided for carbonating and/or maintaining carbonation of a liquid, such as a beverage, stored in a resealable container.

Figure 1:
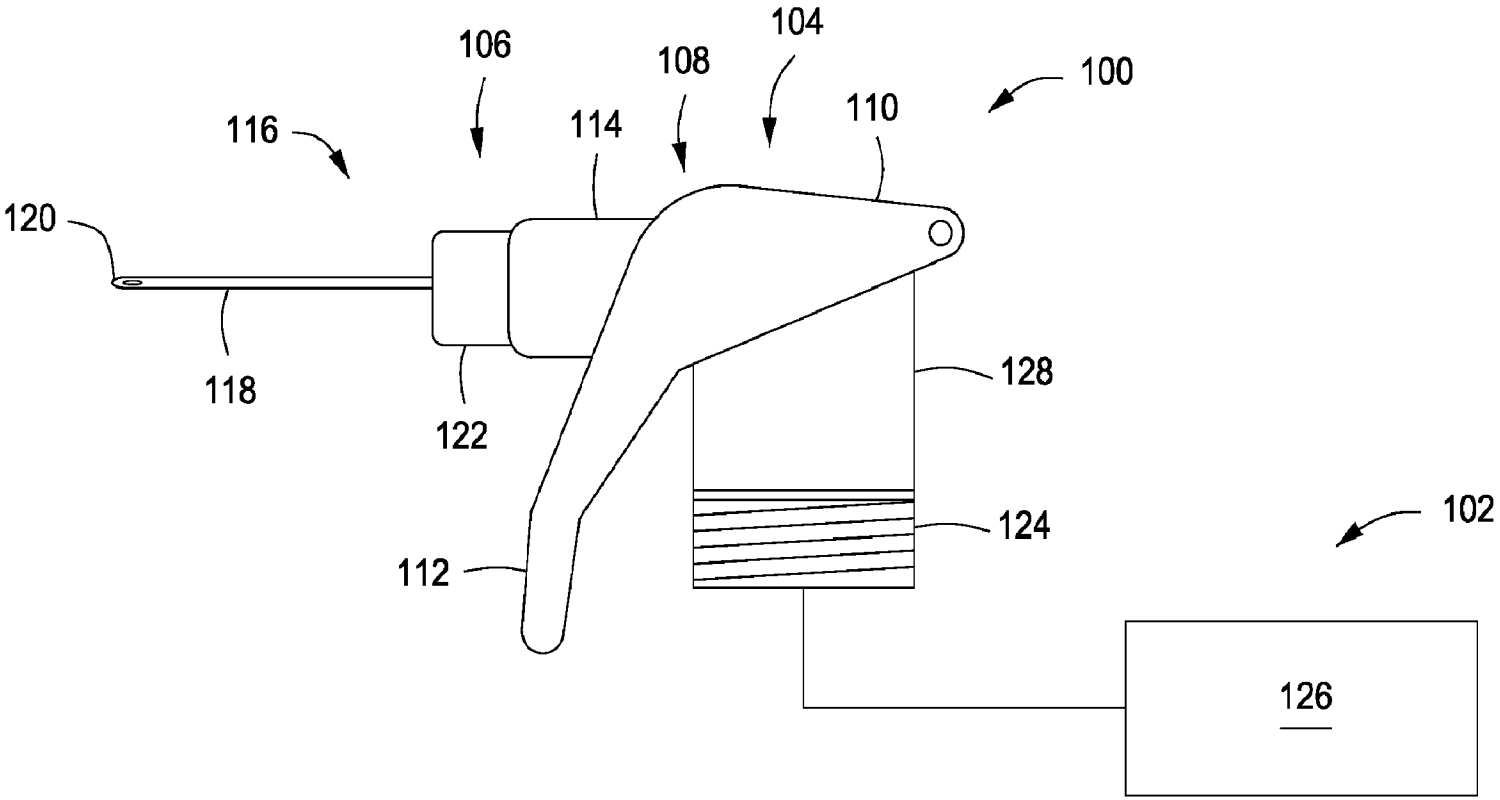
FIG. 1 depicts a schematic view of a system in accordance with one embodiment of the present invention.

FIG. 1 depicts one embodiment of a gas delivery system 100 suitable for transferring a gas, such as carbon dioxide, from a storage vessel 102 to a fluid in a container (not shown) that is to be gasified (e.g., carbonized). The gas delivery system 100 generally includes three main components: a storage vessel 102, a controlled release mechanism 104, and an output portion 106.

The storage vessel 102 employed with the gas delivery system 100 may be any pressure vessel suitable for storing compressed gas and may generally be any size and, for example, may range in size from industrial-sized storage tanks, to medium-sized household tanks, commonly referred to as "5 pound" tanks, to small handheld tanks, such as those used with portable airpowered hand tools, paintball guns, and other similar applications. The size of the storage vessel 102 may be dependant upon the magnitude of the number of applications required by the user. For example, to utilize the present invention in a commercial setting, it may be more cost effective to employ a large, industrial-sized tank. However, most non-commercial household uses would only require a medium-sized tank or a handheld tank, depending on frequency of use, storage space available and/or economic practicality.

In some embodiments, the storage vessel 102 may include a gas source 126 coupled to the controlled release mechanism 104 by a hose (not shown). The gas source 126 may include, for example, a large tank (not shown) or a gas pipeline (not shown). Any gas source 126 is contemplated by embodiments of the present invention. The storage vessel 102 may store any gas useful for gasification of liquids. Exemplary gases include: carbon dioxide, oxygen, nitrogen, and the like.

The controlled release mechanism 104 generally comprises a trigger release 108 for controllably releasing a gas from the storage vessel 126. The trigger release 108 generally includes a base 128, a trigger casing 110, and a trigger 112. The base 128 of the trigger release 108 is generally hollow, or tubular, and is provided with a threaded portion 124 that engages the storage vessel 102 to couple the trigger release 108 thereto. This connection allows the trigger release 108 to remain in constant contact with the storage vessel 102 with a minimal likelihood of accidental separation. Some embodiments of the present invention may incorporate alternative controlled release mechanisms 104, such as, for example, controllable valves, clamps, or the like.

The output portion 106 of the gas delivery system 100 is coupled to the controlled release mechanism 104 to facilitate delivery of the released gas to the liquid to be gasified. The output portion 106 is a generally hollow member having a first end for coupling to the controlled release mechanism 104 and a second end that interfaces with a cap (described with respect to FIGS. 3A-4B) of the container having the liquid to be gasified. The output portion 106 may be any length or configuration and may include one or more rigid or flexible sections.

Figure 2A:
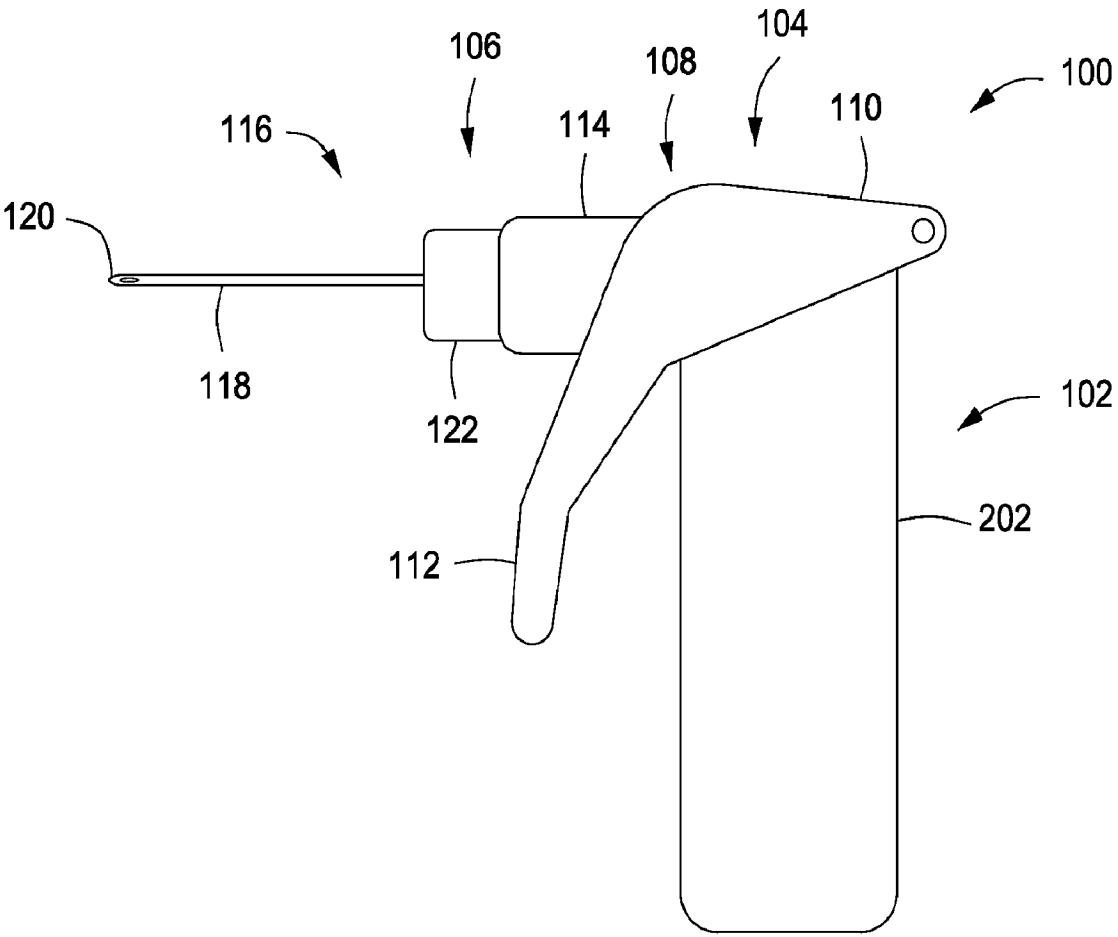
FIG. 2A depicts a side view of one embodiment of a gas delivery system of the present invention.
Figure 2B:
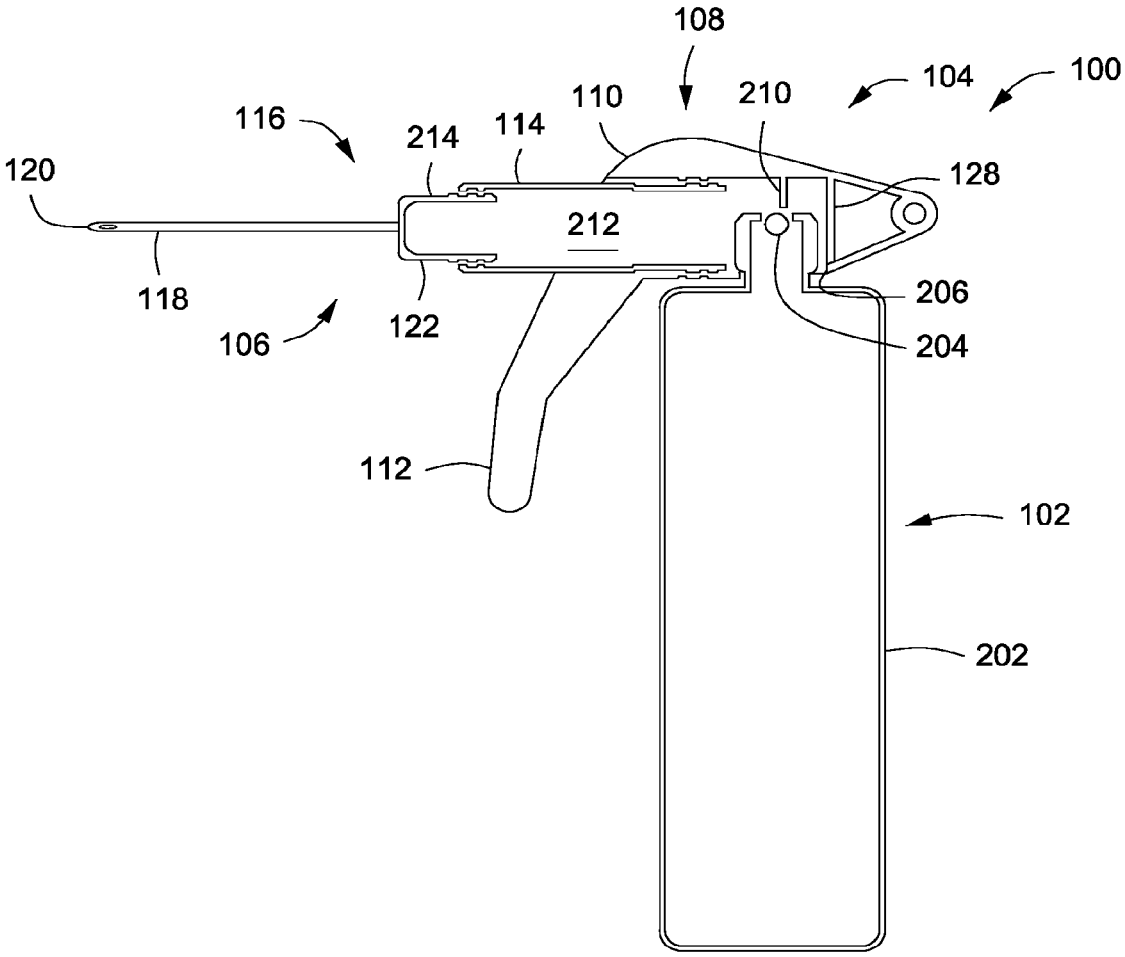
FIG. 2B depicts a cross-sectional side view of the gas delivery system depicted in FIG. 2A.

FIGS. 2A and 2B depict one embodiment of a gas delivery system 100 in accordance with some embodiments of the present invention. The storage vessel 102 typically includes a valve for selectively accessing the interior of the storage vessel 102 (for example to let out the compressed gas contained in the container or to fill/refill the container with compressed gas from an external source of compressed gas.) In the embodiment depicted in FIGS. 2A and 2B, the storage vessel 102 is a handheld carbon dioxide tank 202. Such type of tanks generally provide a pin valve as the means to release the carbon dioxide gas from the tank. Other valves, such as ball valves or any other gas-storing or pressure valve, may be used depending on the tank employed in the gas delivery system 100.

The controlled release mechanism 104 is coupled to the storage vessel 102, for example, via the threaded exterior 206 of the storage vessel 102, and interfaces with the valve (e.g., the valve 204) for controllably releasing the compressed gas through the valve 204. It is contemplated that other mechanisms may be utilized for coupling the controlled release mechanism 104 to the storage vessel 102, such as clamps, straps, cams, levers, press fittings, and the like. It is further contemplated that the controlled release mechanism 104 may be an integral part of the valve 204 of the storage vessel 102 (such as the handle of a ball valve).

The trigger casing 110 has a hollow interior portion 212 and is rotatably coupled to the base 128. A valve release rod 210 extends into the interior portion 212 of the trigger casing 110 and is configured to protrude through the hollow base 128 and align with the valve 204 of the storage vessel 102 when the trigger release 108 is attached thereto, such that the valve release rod 210 contacts, or nearly contacts, the valve 204. The trigger 112 is coupled to the trigger casing 110 such that operation of the trigger 112 controls the degree of rotation of the trigger casing 110 with respect to the base 128. In operation, the trigger 112 is depressed to rotate the trigger casing 110, thereby causing the valve release rod 210 to further engage the valve 204 and release the compressed gas from the storage tank 102 into the hollow interior portion 212 of the trigger casing 110. The amount of gas released is dependant upon the amount of force placed on the trigger 112, the amount of time the valve 204 remains open, and the pressure inside the storage vessel 102.

The output portion 106 includes a hollow fitting 114 and a delivery adapter 122. The hollow fitting 114 is disposed at a first end of the output portion 106. In one embodiment, the fitting 114 has a threaded portion at a first end that facilitates coupling with the trigger casing 110. The fitting 114 further has a threaded portion at a second end to facilitate coupling with the delivery adapter 122.

The delivery adapter 122 generally includes a threaded portion on a first end to facilitate coupling with the fitting 114 and means for penetrating a seal disposed on the container (discussed below with respect to FIGS. 3A and 3B) and delivering the gas to the container, such as a hollow needle 118, disposed at a second end. The hollow needle 118 has an open tip 120 configured to penetrate the seal disposed in the cap of the liquid container (as described below with respect to FIGS. 2A-B and FIG. 3) and deliver the gas thereto.

The respective threaded portions and diameters of the fitting 114 and the delivery adapter 122 may generally be any size so long as they fit together and operate as described herein. One convenient size that may be utilized is a ½ or ¼ inch flare, generally used by the brewing industry as a standard for pressure connections. In one embodiment, the fitting 114 ends in a female National Pipe Thread (NPT). In one embodiment, the fitting 114 is a ½ inch NPT fitting. In one embodiment, the delivery adapter 122 has a male NPT thread 214 on a first end that mates with the female NPT thread on the fitting 21. Optionally, a thread sealant (not shown), such as a polytetrafluoroethylene (PTFE) tape or paste, or the like, may be utilized to assist in creating a leak-free connection. It is also contemplated that sealing methods other than threaded pipe fittings may be used to connect the two fittings 114 and 122.

It is further contemplated that many other arrangements of the output portion 106 may be devised in keeping with the scope of the present invention, including those having fewer or greater components that couple to the controlled release mechanism 104 and provide a needle 118 or similar device for delivering the compressed gas to the liquid container. For example, a flexible hose or conduit may be provided to extend the reach of the output portion with respect to the position of the storage vessel 102 and to add flexibility and ease of use to the operation of the gas delivery system 100.

Figure 3B:
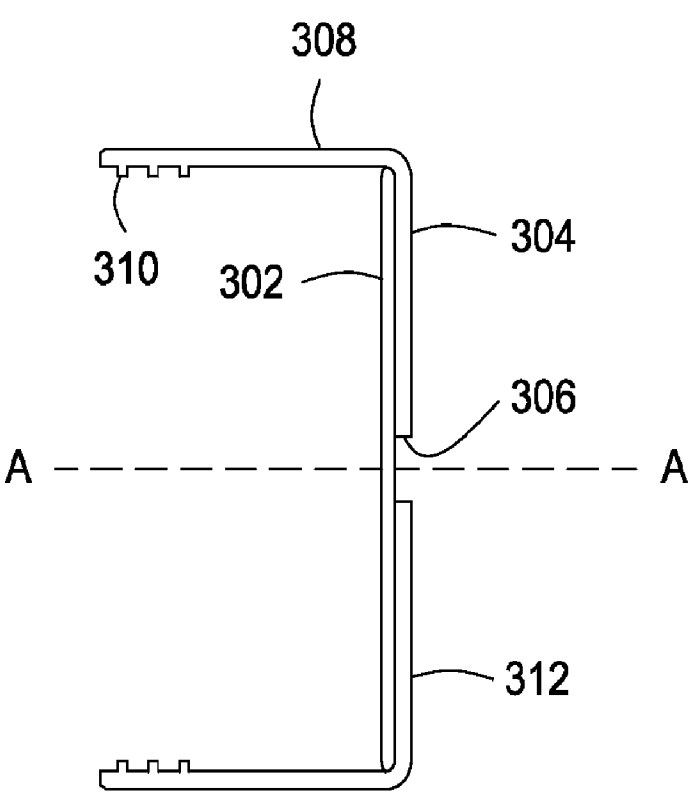
FIG. 3B depicts a cross-sectional side view of the cap and seal depicted in FIG. 3A.
Figure 3A:
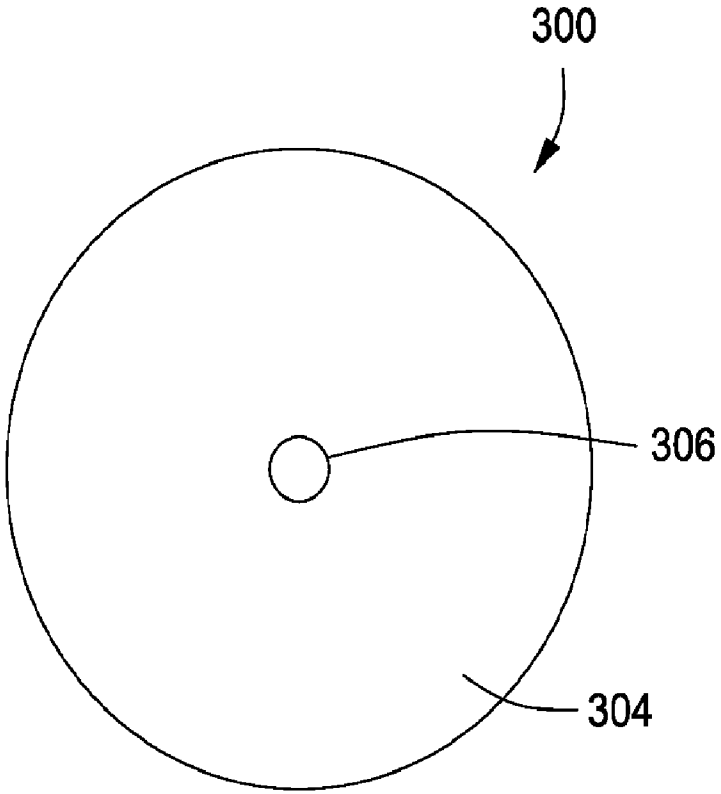
FIG. 3A depicts a top view of one embodiment of a cap and seal of the present invention.

FIGS. 3A and 3B depict one embodiment of a cap 300 and a seal 302 used in connection with the gas delivery system 100 depicted in FIGS. 1, 2A, and 2B. The cap 300 is designed to replace a standard bottle cap, such as those found on conventional plastic and/or glass bottles. In one embodiment, the cap 300 has a generally cylindrical top 304 and a continuous sidewall 308 extending from the perimeter of the top 304. The sidewall 308 has a threaded inner surface 310 that mates with a corresponding threaded surface of the container onto which the cap 300 is to be placed. A hole 306 is formed through the top 304. In one embodiment, the hole 306 may be formed near or through a center of the top 304, as indicated by axis A-A. While FIGS. 3A and 3B depict the hole 306 passing through the center of the top 304, the hole 306 may pass through any portion of the top 304. It is contemplated that the cap 300 may take other forms suitable for capping containers having tops with varying geometries. For example, the cap 300 may be a steel cap, such as are used to seal glass soda and beer bottles. Additional equipment, such as a crimping tool, may be required to affix the steel cap to a glass bottle.

The seal 302 is formed so that it fits securely inside the cap 300 against an inner surface 312 of the top 304 and such that a peripheral edge of the seal 300 will be compressed between the inner surface 312 of the top 304 and an upper edge of the container when the cap 300 is secured to the container in order to form a seal sufficient to withstand the pressure within the container. The seal 302 is typically made of substantially thin plastic or elastomeric material, however other materials may be used, such as rubbers, elastomers, coated paperboard, and the like. The material used may be approved by the Food and Drug Administration (FDA) for use in connection with food products. In one embodiment, the seal 302 comprises nitrile, or Buna N.

The material of the seal 302 may have any thickness or hardness suitable to be placed between the cap 300 and the container to be sealed. In one embodiment, the seal 302 comprises an FDA Nitril material having a Duro 55 hardness. In one embodiment, the thickness of the seal 302 is between about 1/32 inch to about 1/2 inch (about 0.8-2.4 mm). In one embodiment, the seal is about 1/16 of an inch thick (about 1.6 mm).

Figure 4B:
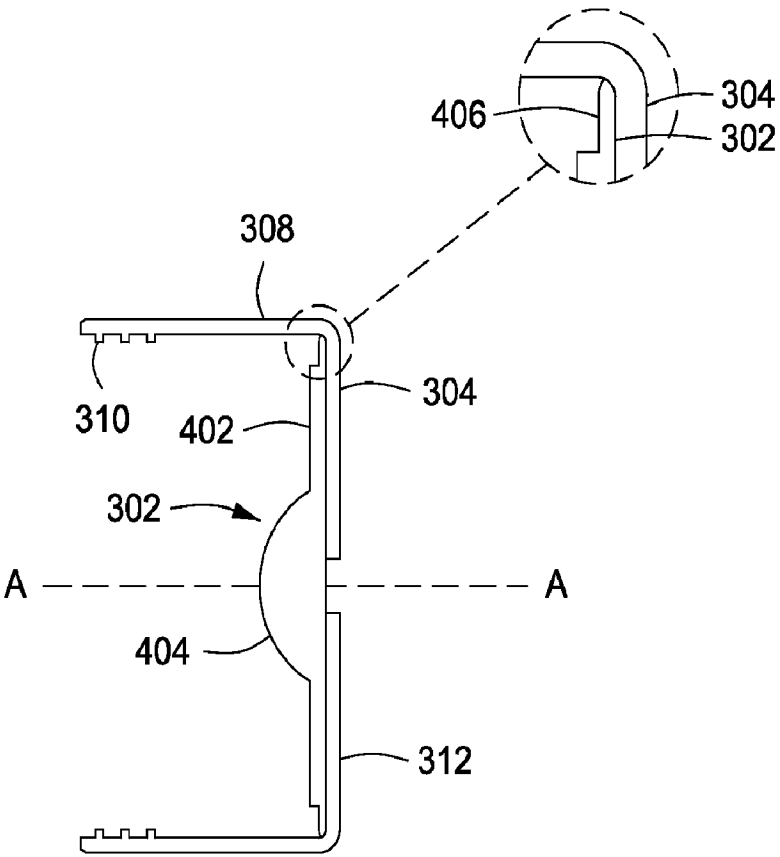
FIG. 4B depicts a cross-sectional side view of the cap and seal depicted in FIG. 4A.
Figure 4A:
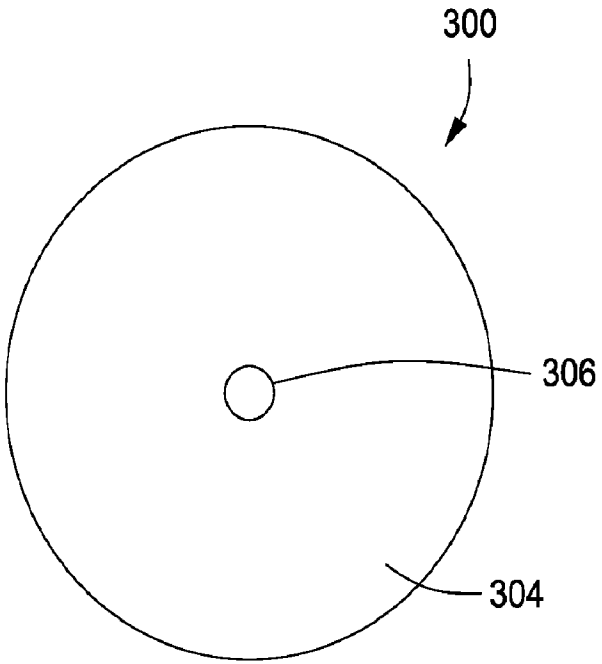
FIG. 4A depicts a top view of another embodiment of a cap and seal of the present invention.

Optionally, the thickness of the seal may be non-uniform. As shown in FIGS. 4A and 4B, depicting a cap and seal in accordance with some embodiments of the present invention, the seal may be thicker in a central portion 404 of the seal and thinner along the periphery 402 of the seal. The thickness of the seal may vary depending on the desired pressure in the container. In some embodiments, the seal 302 may have a half sphere or other rounded shape formed or disposed in the thicker central portion 404 of the seal 302 to facilitate utilizing the pressure in the container to better seal the orifice once the needle is removed. Alternatively or in combination, the seal 302 may have a lip 406 that circumscribes the seal 302 and is configured to extend between the top 304 of the cap 300 and the container to which the cap 300 is attached, thereby reducing the amount of deformation of the seal when tightening the cap 300 to the container.

The seal 302 acts as a one-way valve when a small puncture is made therethrough. In operation, when the seal 302 is penetrated by a device (not shown) such as the needle 118 described above with respect to FIGS. 2A and 2B, the seal 302 may tear slightly to form a flap (not shown) that facilitates forming a one-way valve that prevents fluid flow from the container through the seal due to the pressure exerted against the flap by the contents of the container. The seal 302 may further have elastic properties or hardness characteristics that facilitate closing up the puncture hole once the needle 118 is removed. It is further contemplated that the seal 302 may be fabricated with a slit or opening pre-formed therein. The opening is biased towards a closed position that prevents the pressurized contents of the container from escaping. The opening may be penetrated by a device (e.g., the needle 118) to deliver the pressurized gas to the container.

Although described with respect to conventional bottles or containers, it is contemplated that the above described cap and seal may be modified to be utilized in combination with other containers. For example, instead of replacing the cap on a conventional bottle, a seal, cap, and container combination may be designed and used to store and gasify a liquid. In addition, caps and seals may be configured to fit over conventionally non-resealable containers such as beer bottles, champagne bottles, and the like.

Figure 5:
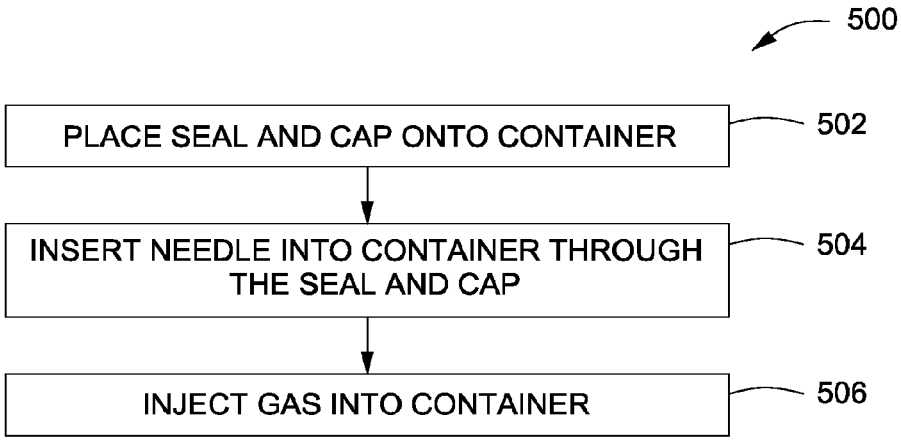
FIG. 5 depicts a flow chart of a method of operation of one embodiment of the present invention.

FIG. 5 depicts one embodiment of a method 500 of gasifying a liquid using the apparatus depicted in FIGS. 1-4B. At step 502, the cap 300 and seal 302 are attached securely to a container having liquid to be gasified. The cap 300 should be affixed firmly onto the container, however the cap 300 should not be not over-tightened. Over-tightening of the cap 300 may cause the seal 302 to pull away from the inner surface 312 of the cap 300, potentially allowing the pressurized contents of the container to leak. If over-tightening occurs, the cap 300 may be removed, the seal 302 adjusted to its proper location, and the cap 300 retightened.

At step 504, the needle 118 is inserted into the container through the seal 302 and the cap 300. The needle 118 may be used to form a hole through the seal 302 via the hole 306 in the top 304 of the cap 300. If the seal 302 has not been used before, or the seal 302 is not pre-punctured, the force required to puncture the seal 302 may be substantially more than one might expect. Due to the thickness of the seal 302, it may be beneficial to pre-puncture the seal 302, so that a needle may penetrate into a container during use. If the seal 302 is pre-punctured and/or has been used in a previous application, the needle 118 may be inserted in the same location as the original puncture.

At step 506, the gas is injected into the container to gasify the liquid contents of the container. If the gas delivery system 100 provides a regulator (not shown) for adjusting the pressure of the released gas, the regulator may be adjusted to appropriate levels depending on the fluid being gasified (e.g., carbonated) and the level of gasification (e.g., carbonation) desired. For example, for most beverages, a still fluid being initially carbonated reacts well to a regulator set to approximately 25 psi, whereas a previously carbonated fluid being re-carbonated reacts well to a lower set point, such as approximately 5 psi. Typically, small handheld carbon dioxide delivery systems do not have regulators, in which case no adjustments are necessary. After the gas is injected into the container at step 506, the method 500 ends.

Figure 6:
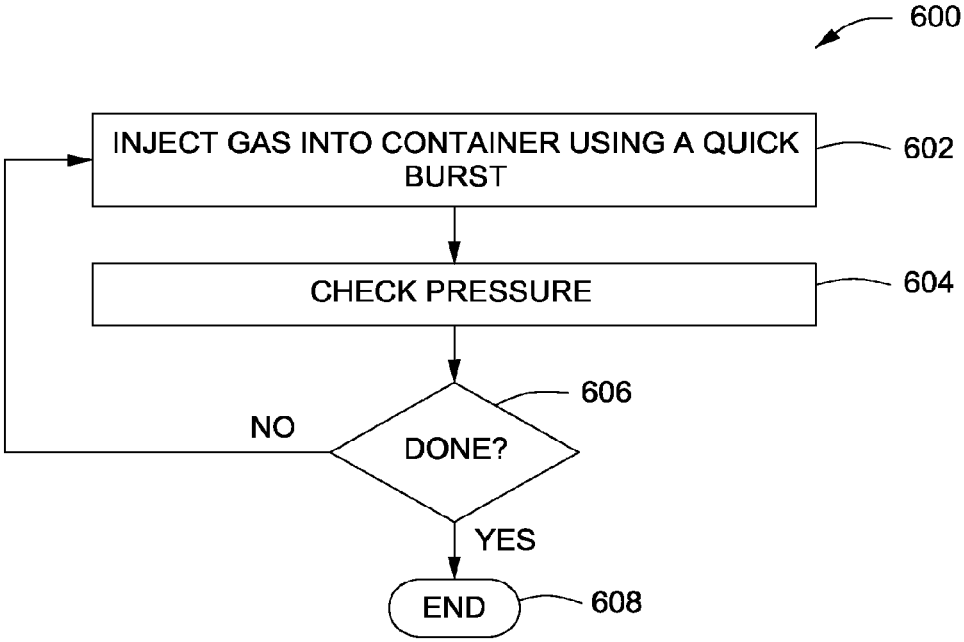
FIG. 6 depicts a flow chart of one embodiment of a method of injecting gas into a container.

FIG. 6 depicts one embodiment of a method 600 of injecting gas into a container, suitable for use in conjunction with the method 500 described with respect to FIG. 5. The method 600 begins at step 602, where a gas is injected into the container using short, controlled bursts. The gas (e.g., carbon dioxide) is typically injected in short bursts into the container until the container becomes firm to the touch. The amount of gas injected into the container is dependant on many factors and may vary from application to application.

As such, at step 604, the pressure of the container is checked. The pressure of the container may be checked by hand, for example by feeling if the container is firm to the touch. However, a pressure gauge may be utilized to measure the pressure of the container to ensure that it is properly gasified. Generally, for carbonated beverages, 5-10 psi has been found to be sufficient for temporary storage or transport of previously carbonated beverages, and 20-30 psi has been found to be suitable for carbonating previously noncarbonated beverages. However, it is contemplated that other pressure levels may be utilized as well. If properly used, the present invention may safely gasify bottled beverages up to about 45 psi.

At step 606, a decision is made whether the process is done, i.e., whether the pressure in the container is sufficient based upon the guidelines detailed above. If the process is done, the method ends at step 608. If the process is not done, the method returns to step 602 to inject another quick burst of gas into the container. When carbonating a previously non-carbonated beverage, the process of injecting carbon dioxide may be repeated several times over a 48 hour period. Typically, repeating the injection process once every 12 hours for 48 hours will ensure proper carbonation.

Since certain changes may be made in the above described invention without departing from the spirit and scope of the invention herein involved, it is intended that all of the subject matter of the above description or shown in the accompanying drawings shall be interpreted merely as examples illustrating the inventive concept herein and shall not be construed as limiting the invention.

Figure 7:
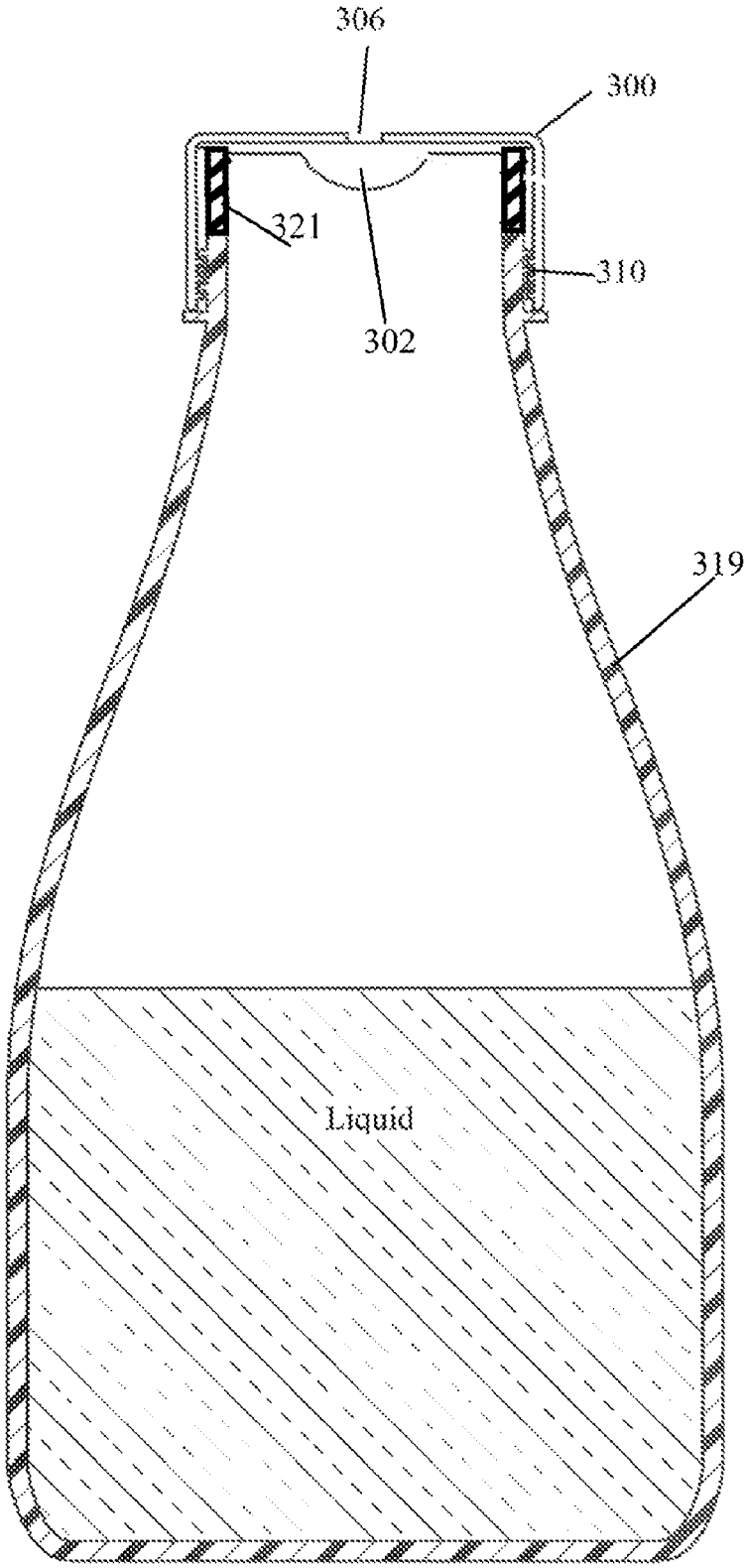
FIG. 7 is an elevation view of a container having a cap and seal as described herein.
Figure 8:
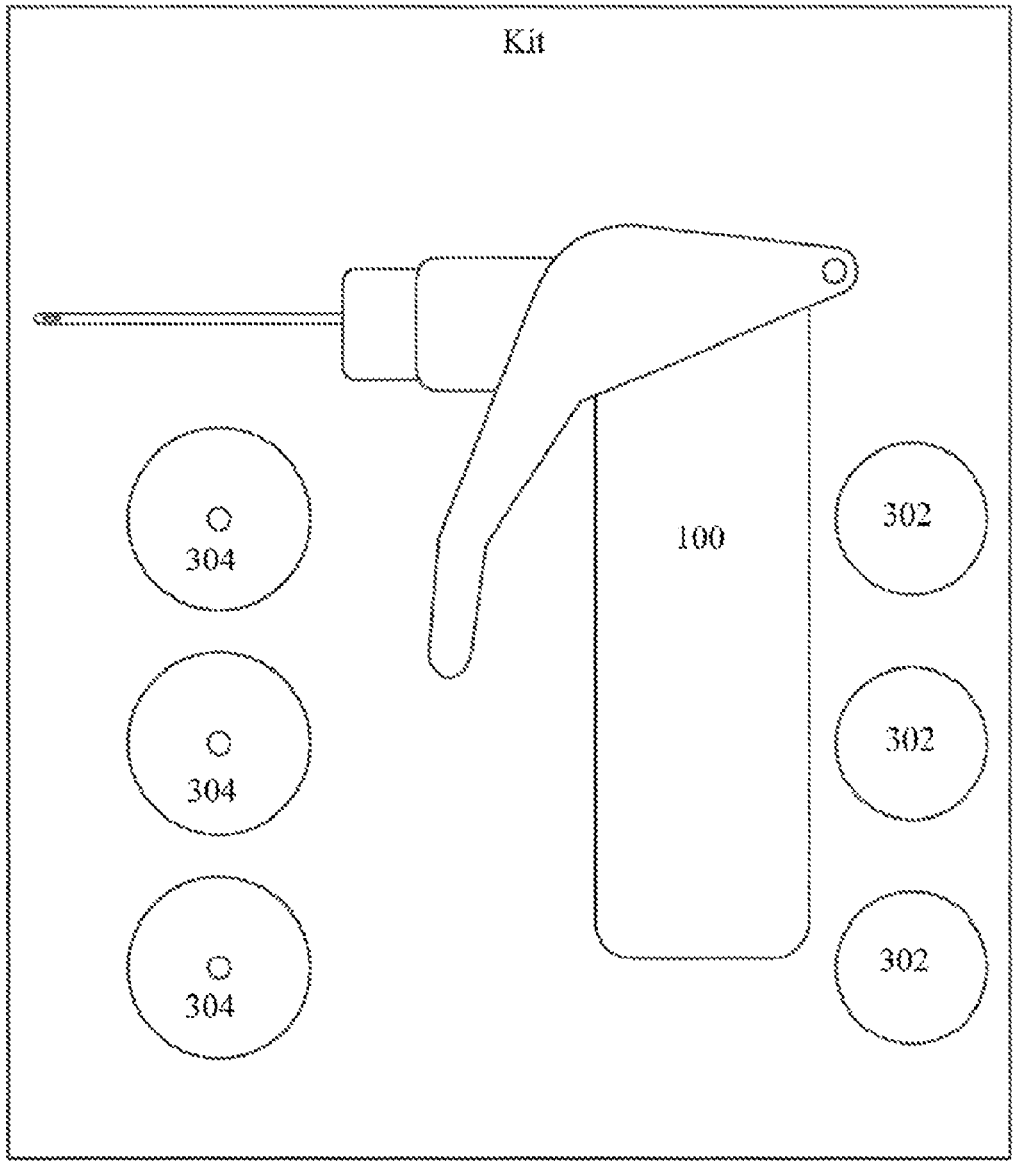
FIG. 8 is a plan view of a kit having a gas delivery system and a plurality of caps and seals according to the system described herein.

FIG. 7 shows a container 319 that defines an opening at a top end extending within the wall 321 of the container. Though not specifically numbered, the opening of the container is that uncovered area within the wall 321 of the container at one end of the container from which a liquid in the container would be poured into and out of the container. In FIG. 7, the opening is just below the seal 302 and between opposition portions of the container wall 321. The container defines a closed bottom end such that the container 319 holds a liquid therein when the container is in an upright position. Without limiting the invention in any way, an upright position is one in which the top end is positioned over the bottom end so that the container holds a liquid in its upright position with the top end proximate a user. FIG. 7 further shows that the cap 300 has threading 310 that may engage corresponding threading on the container 319. FIG. 7 shows that the walls of the container extend all the way up to the seal 302, such that when the seal 302 is placed over the opening defined by the container, the container wall 321 holds the seal in place directly adjacent the cap 300. Furthermore, the seal 302 is removably located within the cap 300 in a position that is spaced apart from the threading 319 on the cap. In this way, when the cap 300 is threaded onto the container 319, the seal 302 does not absorb the torque of the screwing action that forces the cap 300 onto the container. This construction avoids the problem of the elastomeric seal absorbing torque due to the screwing down of the cap but tending to unscrew the cap when the cap is released by the user. Instead, the threading 310 is separated from the seal along the wall 321 of the container 319 so that the screwing and unscrewing of the cap does not implicate the seal at all.

What is claimed is:

1. A liquid gasification system comprising:

a container defining an open section at a top end of said container and a closed section at a bottom end of said container, wherein said container is at least partially filled with a liquid and wherein said top end is positioned above said bottom end of said container when said container is in an upright position;

a removable seal enclosing the open section of the container;

a gas delivery system comprising:

a storage vessel storing a gas therein; and an output portion connected to said storage vessel to deliver the gas from the storage vessel to an interior of the container;

wherein said output portion penetrates said seal with said container in the upright position before delivering the gas and wherein said output portion is adapted to be removed from said seal after delivering the gas; and wherein, after removal of said output portion of said gas delivery system from said seal, said seal remains positioned to enclose the open section of said container; and a cap engaging said seal and adapted to engage the container about the open section, said cap defining a hole in a top surface of said cap for receiving said output portion of said gas delivery system.

2. A liquid gasification system according to claim 1, wherein said output portion penetrates said seal through the hole in said cap, and said cap sufficiently engages the container to retain said seal adjacent the open section of the container upon removal of said output portion from said seal.

3. A liquid gasification system according to claim 1, wherein said seal further comprises a one way valve formed when said output portion penetrates said seal, wherein, upon removal of said output portion from said seal, said one way valve closes and said seal continues to enclose an open section of the container.

4. A liquid gasification system according to claim 1, wherein said seal is sufficiently elastomeric to close a puncture formed by removal of said output portion of said gas delivery system from said seal.

5. The liquid gasification system of claim 1, wherein said storage vessel stores the gas in the absence of liquid within the storage vessel.

6. The liquid gasification system of claim 1, wherein a central region of said seal is thicker than a peripheral region of said seal.

7. The liquid gasification system of claim 1, wherein said seal further comprises a lip circumscribing said seal and configured to extend between a top of said cap and said container when said cap is attached to said container.

8. The liquid gasification system of claim 1, wherein said output portion comprises a needle having an open end for delivering gas to the container.

9. A kit for gasifying a liquid contained in a resealable container, the container defining an open section at a top end of said container and a closed section at a bottom end of said container wherein the top end is above the bottom end when the container is in an upright position, comprising:

a cap defining an opening disposed in a top surface of said cap, said cap further defining threading within the interior of said cap;

a seal configured to fit within said cap, said seal fitting into said cap in a position adjacent the opening and spaced apart from said threading and wherein said seal has a central portion that is thicker than a peripheral portion of said seal;

and a gas delivery system comprising an output portion that extends through the opening in the cap with the container in the upright position to penetrate said seal before delivering a gas to the container, said output portion further being removable from said seal after delivering the gas while maintaining the container in an upright position;

wherein said seal remains positioned to enclose the container after removal of said output portion of said gas delivery system from said seal.

10. The kit of claim 9, further comprising a gas storage vessel for connecting to said output portion.

11. The kit of claim 9, further comprising a controllable release mechanism connected to said output portion to control gas delivery, wherein said controllable release mechanism is a trigger device.

12. The kit of claim 9, wherein said cap further defines threading for connecting to the container.

13. The kit of claim 12, wherein said seal fits within the cap and spaced apart from said threading such that the container holds said seal against said cap without said seal engaging said threading.

14. A liquid gasification system comprising:

a container defining an open section at a top end of said container and a closed section at a bottom end of said container, wherein said container is at least partially filled with a liquid and wherein said top end is positioned above said bottom end of said container when said container is in an upright position;

a removable seal enclosing the open section of the container;

a gas delivery system comprising:

a storage vessel storing a gas therein; and an output portion connected to said storage vessel to deliver the gas from the storage vessel to an interior of the container;

wherein said output portion penetrates said seal with said container in the upright position before delivering the gas and wherein said output portion is adapted to be removed from said seal after delivering the gas; and wherein, after removal of said output portion of said gas delivery system from said seal, said seal remains positioned to enclose the open section of said container; and a cap fitting onto the open section of the container and engaging said seal, said cap defining a hole in a top surface of said cap for receiving said output portion of said gas delivery system, wherein said seal further comprises a lip circumscribing said seal and configured to extend between a top of said cap and said container when said cap is attached to said container.

15. A liquid gasification system according to claim 14 wherein said output portion penetrates said seal through the hole in said cap, and said cap sufficiently engages the container to retain said seal adjacent the open section of the container upon removal of said output portion from said seal.

16. A liquid gasification system according to claim 14, wherein said seal further comprises a one way valve formed when said output portion penetrates said seal, wherein, upon removal of said output portion from said seal, said one way valve closes and said seal continues to enclose an open section of the container.

17. A liquid gasification system according to claim 14, wherein said seal is sufficiently elastomeric to close a puncture formed by removal of said output portion of said gas delivery system from said seal.

18. The liquid gasification system of claim 14, wherein said storage vessel stores the gas in the absence of liquid within the storage vessel.

19. The liquid gasification system of claim 14, wherein a central region of the seal is thicker than a peripheral region of the seal.

20. The liquid gasification system of claim 14, wherein said output portion comprises a needle having an open end for delivering gas to the container.

* * * * *